US008651271B1

(12) United States Patent
Shen

(10) Patent No.: US 8,651,271 B1
(45) Date of Patent: Feb. 18, 2014

(54) CONTAINER WITH MULTIPLE CHAMBERS AND MULTIPLE OPENINGS

(71) Applicant: Tzu-Yuan Shen, Puli Township (TW)

(72) Inventor: Tzu-Yuan Shen, Puli Township (TW)

( * ) Notice: Subject to any disclaimer, the term of this patent is extended or adjusted under 35 U.S.C. 154(b) by 0 days.

(21) Appl. No.: 13/776,966

(22) Filed: Feb. 26, 2013

Related U.S. Application Data

(63) Continuation-in-part of application No. 13/569,532, filed on Aug. 8, 2012.

(51) Int. Cl.
*B65D 6/28* (2006.01)

(52) U.S. Cl.
USPC ..... 206/216; 220/4.27; 220/23.4

(58) Field of Classification Search
USPC ..... 206/216; 220/23.83, 23.86, 23.2, 23.4, 220/23.6, 23.8, 4.27
See application file for complete search history.

(56) References Cited

U.S. PATENT DOCUMENTS

| | | | | | |
|---|---|---|---|---|---|
| 3,194,426 | A * | 7/1965 | Brown, Jr. | ..... | 220/23.4 |
| 3,876,112 | A * | 4/1975 | Kramer | ..... | 222/132 |
| 4,656,840 | A * | 4/1987 | Loofbourrow et al. | ..... | 62/530 |
| 5,356,040 | A * | 10/1994 | Reggiani | ..... | 222/129 |
| 5,810,192 | A * | 9/1998 | Cruz | ..... | 220/475 |
| 5,823,391 | A * | 10/1998 | Klauke et al. | ..... | 222/94 |
| 2001/0030191 | A1 * | 10/2001 | Bopp et al. | ..... | 220/23.4 |
| 2006/0108363 | A1 * | 5/2006 | Yates, III | ..... | 220/23.4 |

* cited by examiner

*Primary Examiner* — Jacob K Ackun
(74) *Attorney, Agent, or Firm* — Wang Law Firm, Inc.; Li K. Wang; Stephen Hsu

(57) ABSTRACT

A container with multiple chambers and multiple openings consists of two bottles not in fluid communications. Each of the two bottles has an upper opening facing upward and a lower opening facing downward, both sealed by an upper cover and a lower cover, respectively. The surrounding surface of each of the two bottles is divided into a junction surface and an outer side surface. Each of the junction surfaces has a connecting part. The two bottles are connected/separated by the connecting parts on the junction surfaces horizontally. The outer side surface of each of the two bottles has the shape of an arc, so that the connected bottles form a complete single cylindrical container.

5 Claims, 8 Drawing Sheets

CONTAINER WITH MULTIPLE CHAMBERS AND MULTIPLE OPENINGS

This application is a Continuation-In-Part Application of Ser. No. 13/569,532, filed on Aug. 8, 2012 and entitled "Container with multiple chambers and multiple openings", now pending.

BACKGROUND OF THE INVENTION

1. Field of Invention

The invention relates to a container and, in particular, to a container with multiple chambers and multiple openings.

2. Related Art

Usually, a beverage container has only an accommodating space to accommodate one kind of beverage. It is therefore impossible to accommodate different kinds of beverage within the same container.

FIG. 8 shows a combination structure of containers. It includes several inflatable spaces 3 connected in a row, each of which is defined with a container space 31 and an inflation space 32 covering the container space 31. The inflation space 32 of each of the containers 3 is formed with a channel 33 to connect to each other, so that the containers 3 are connected together.

Although the above-mentioned structure can accommodate different kinds of beverages in the provided containers, the containers cannot be separated for cleaning. It is thus inconvenient.

Besides, the above-mentioned structure has two or more containers connected in series. After the combination, the volume of the container becomes larger. The shape of the container is not easy to hold. There is still inconvenience.

SUMMARY OF THE INVENTION

An objective of the invention is to provide a container with multiple chambers and multiple openings. The container consists of two bottles for accommodating two different beverages. A detachable junction is interposed between the bottles, so that the two bottles can be combined into one or separated into two.

Another objective of the invention is to have special shapes for the bottles so that a perfect cylinder container is obtained when they are connected. This is easier for the user to hold.

To achieve the above-mentioned objectives, the invention includes two bottles. The interior of each of the bottles is formed with a chamber for holding a beverage. The chambers are not in fluid communications. Each of the chambers is formed with an upper opening facing upward and a lower opening facing downward. Each of the upper openings has an upper cover to seal the corresponding upper opening. Each of the lower openings has a lower cover to seal the corresponding upper opening. The surrounding surface of each of the two bottles is defined with a junction surface and an outer side surface. The junction surfaces of the two bottles are connected horizontally. Each of the two junction surfaces is provided with a connecting part for the connection as well as the separation of the two bottles. The outer side surface of each of the two bottles is formed into a semicircular arc. The junction surfaces of the two bottles are a concave surface and a convex surface smoothly connected together. The concave and convex surfaces are also in the shape of a semicircular arc. The curvature radius of the junction surfaces is half that of the outer side surfaces. The concave surface of one bottle matches with the convex surface of the other bottle, so that the combined shape is a single cylindrical container.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
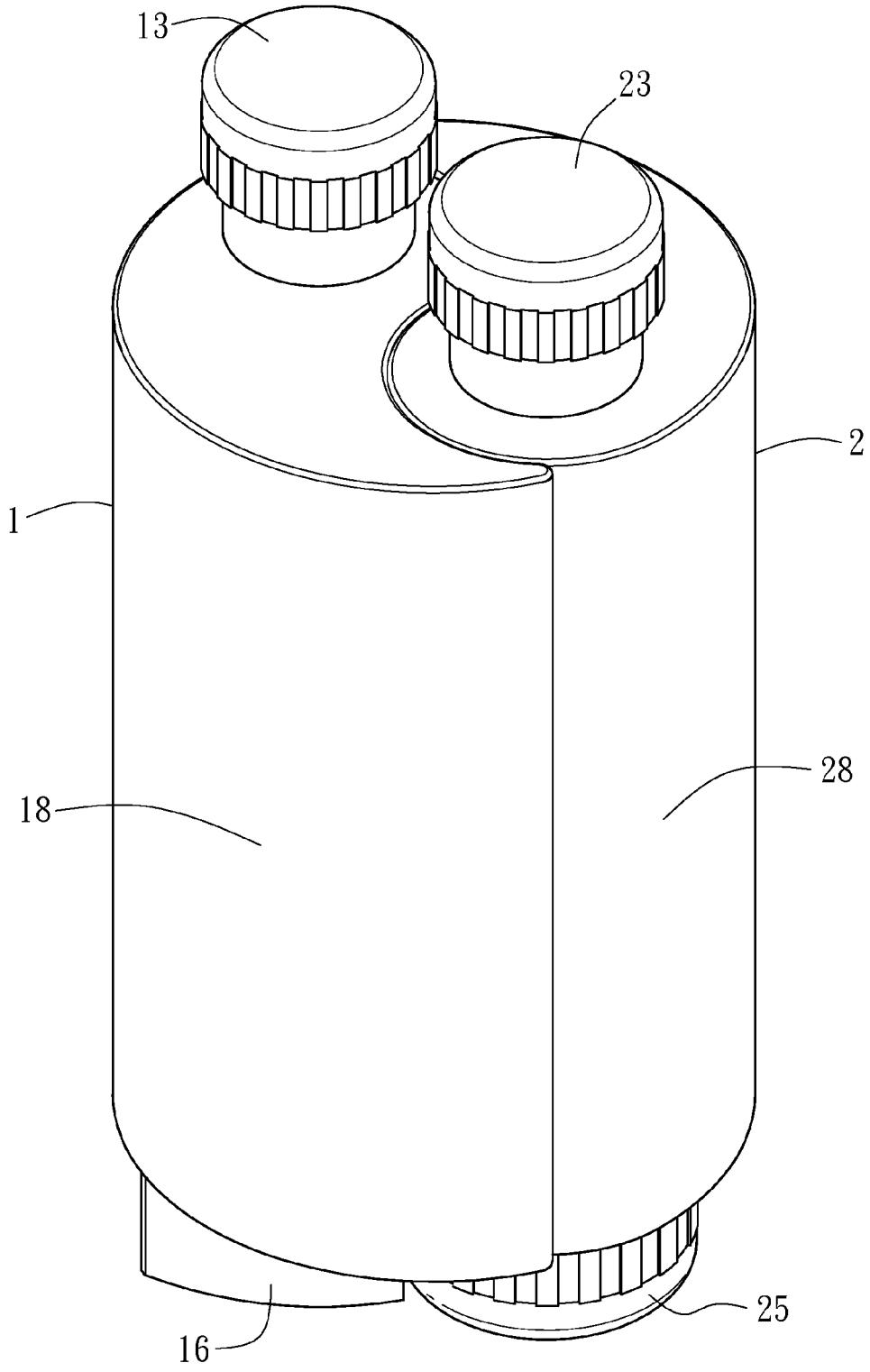
FIG. 1 is a three-dimensional assembly view of the first embodiment.
Figure 2:
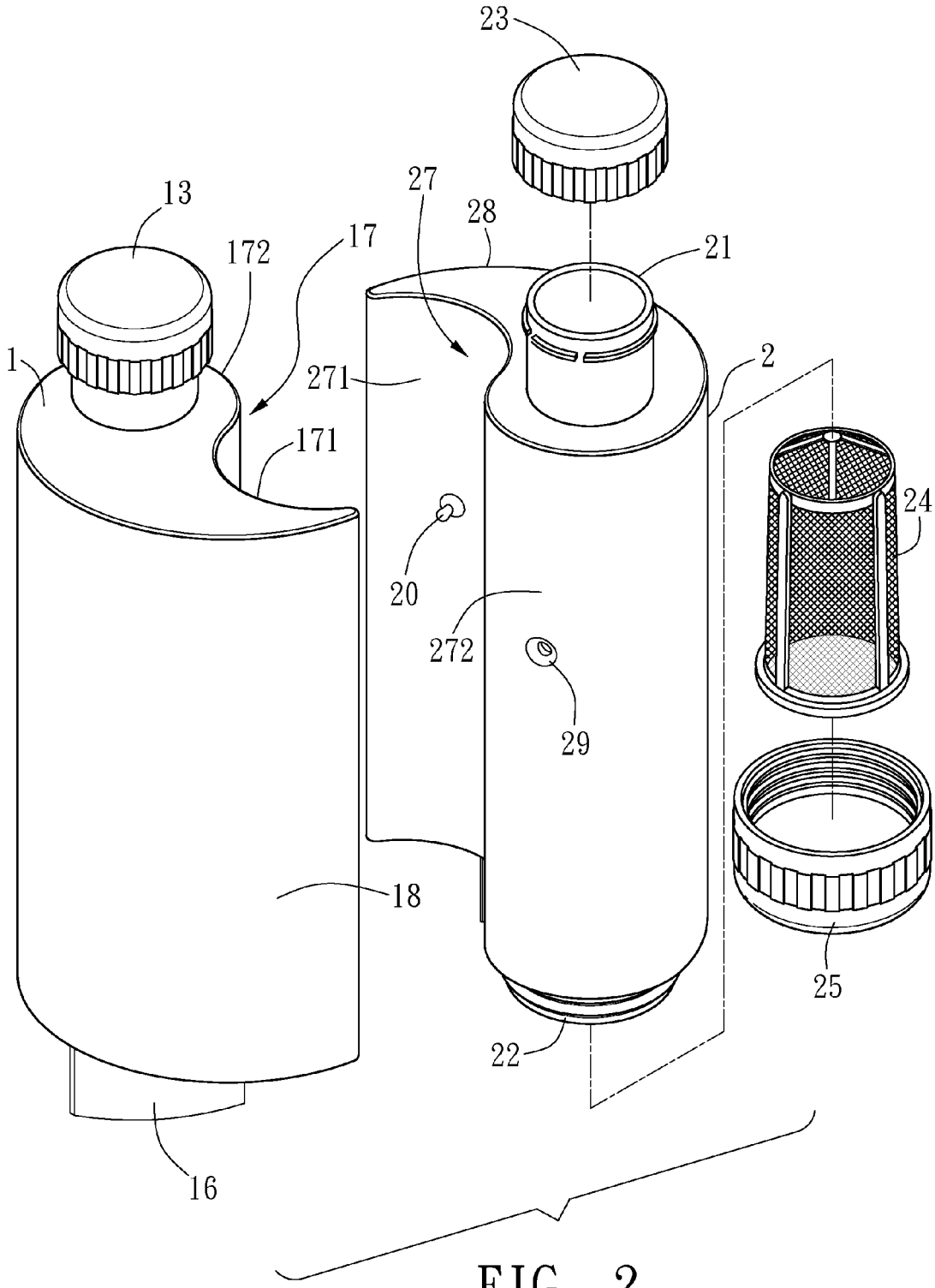
FIG. 2 is a three-dimensional exploded view of the first embodiment.
Figure 3:
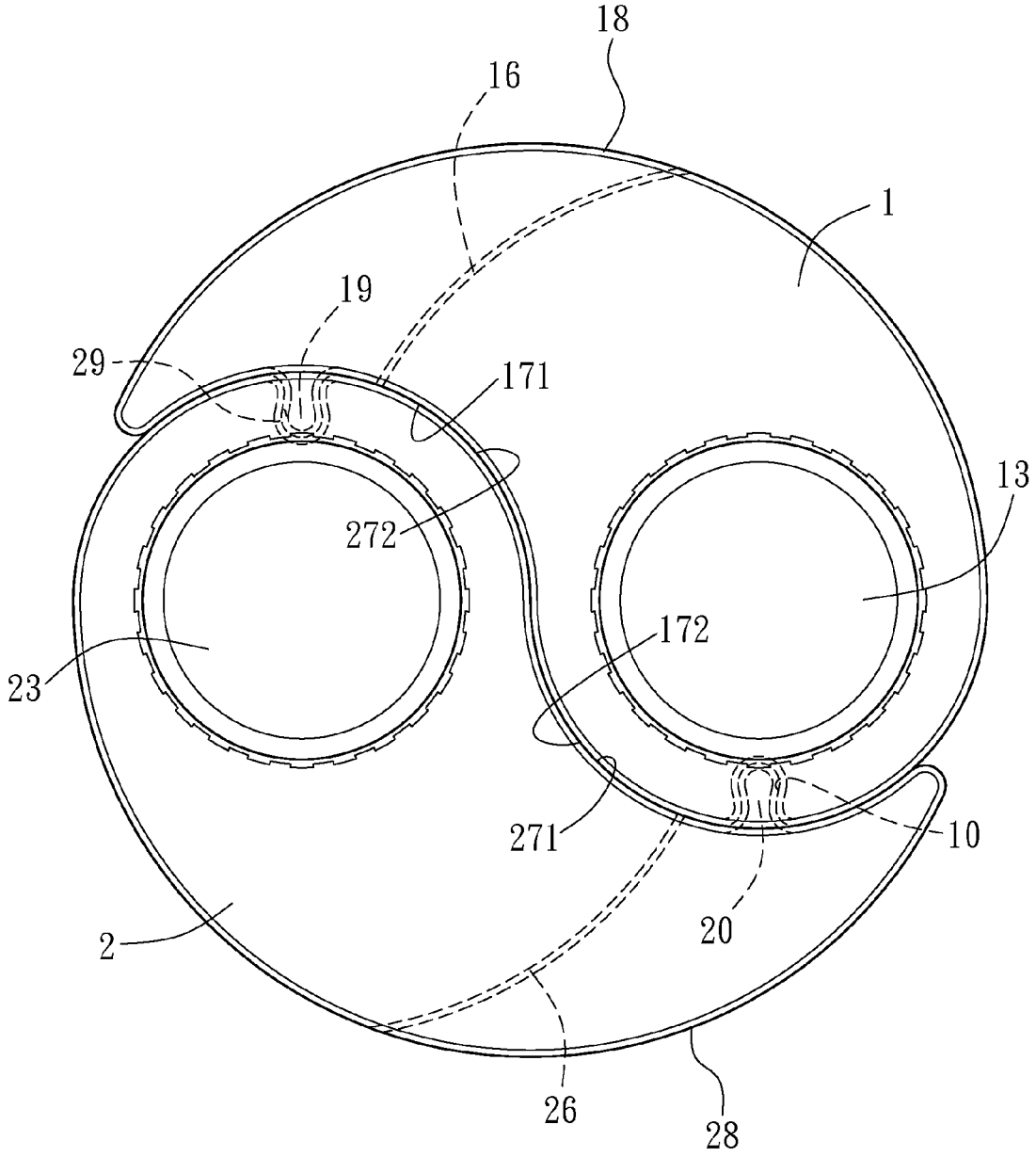
FIG. 3 is a top view of the first embodiment.

Please refer to FIGS. 1 to 3 for a first embodiment of the disclosed container with multiple chambers and multiple openings. The invention includes two bottles 1, 2 of the same structure. Therefore, the following description concentrates exclusively on the bottle 2. The interior of the bottle 2 is formed with a chamber (not shown) for holding a beverage. This chamber is not in fluid communications with the chamber of the other bottle 1. The chamber is formed with an upper opening 21 facing upward and a lower opening 22 facing downward. The upper opening 21 is provided with an upper cover to seal it. In this embodiment, the lower opening 22 is provided with a filter extending toward the chamber thereof. The filter 24 is provided around the rim of the lower opening 22. A lower cover 25 is provided at the lower opening 22 to seal it. The lower cover 25 also urges the filter 24 against the rim of the lower opening 22. The bottom surfaces of the bottles 1, 2 have respectively a supporting board 16, 26 to support the bottles 1, 2, preventing them from toppling.

The disclose container consists of two bottles 1, 2. As shown in FIG. 3, the surrounding surface of each of the two bottles 1, 2 is divided into a junction surface 17, 27 and an outer side surface 18, 28. The two bottles 1, 2 are horizontally connected via the junction surfaces 17, 27, each of which has a connecting part connecting or disconnecting the two bottles 1, 2. In this embodiment, as shown in FIGS. 2 and 3, the connecting parts of the two bottles 1, 2 have concave and convex structures correspondingly matching each other. Suppose one of them is a first hole 29. Then the other is a corresponding first protruding block that engages with the first hole 29. The two bottles 1, 2 can thus be connected horizontally at the same level. Besides, the junction surfaces 17, 27 of the two bottles 1, 2 are further formed with an auxiliary connecting part, respectively. The auxiliary connecting parts can be concave and convex structures that match with each other. Suppose one of them is a second hole 10. Then the other is a second protruding block 20 that engages with the second hole 10. The engaging direction of the auxiliary connecting parts is parallel to that of the connecting parts. When the two bottles 1, 2 approach each other, the auxiliary connecting parts are connected at the same time as the connecting parts connect with each other, reinforcing the connection. To separate the two bottles 1, 2, one simply imposes horizontal forces in opposite directions to pull the two bottles 1, 2 apart.

Figure 4:
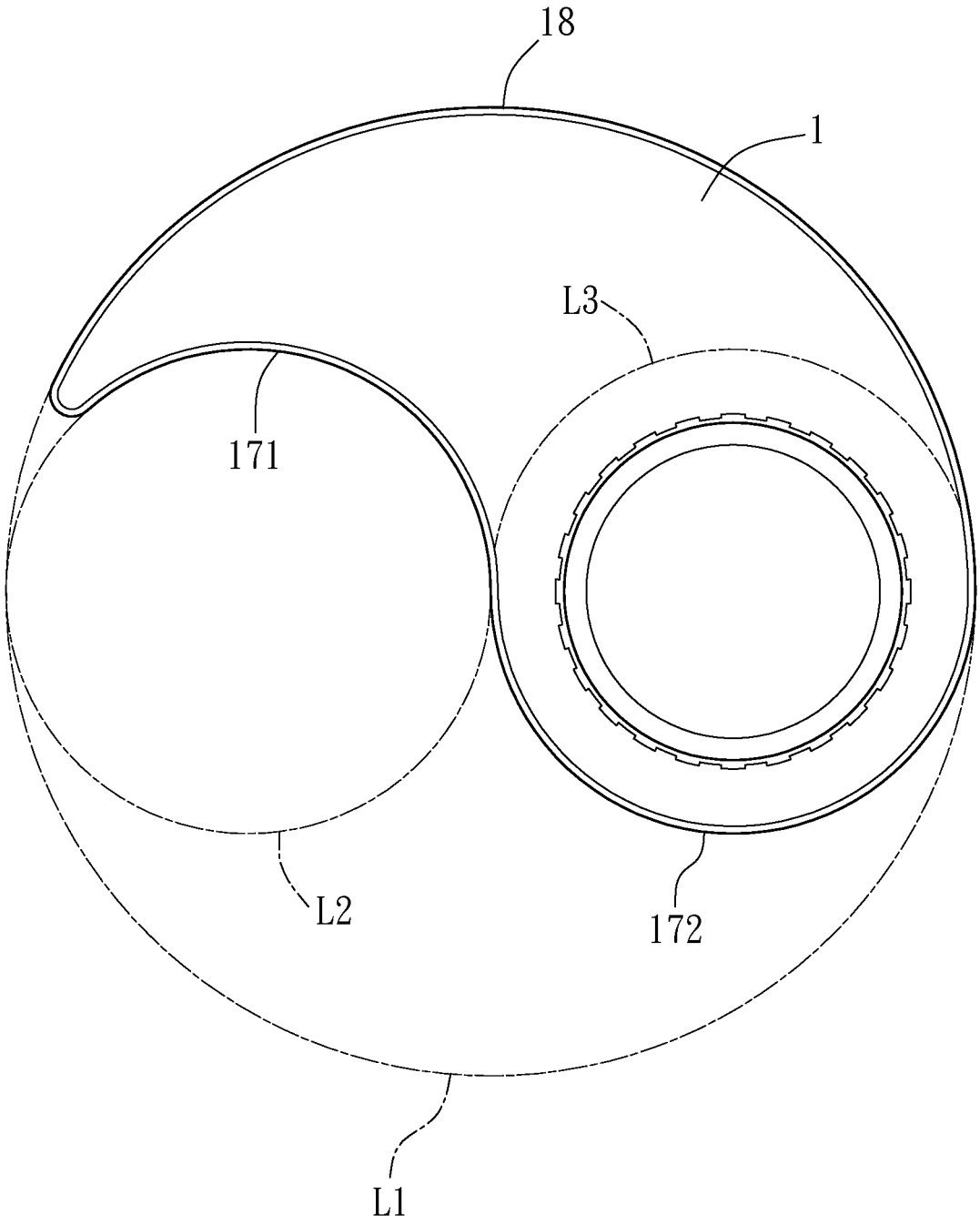
FIG. 4 is a top view of one of the bottles in the first embodiment, illustrating the shape thereof.

As described above, the outer side surfaces 18, 28 of the bottles 1, 2 have a semicircular arc shape. Therefore, the combination of the two bottles 1, 2 forms a complete single cylindrical container for the user to hold easily. On the other hand, the junction surfaces 17, 27 of the two bottles 1, 2 are connected smoothly via concave surfaces 171, 271 and convex surfaces 172, 272. The concave surfaces 171, 271 and the convex surfaces 172, 272 are also semicircular, with the curvature radius being half that of the outer side surfaces 18, 28. As shown in FIG. 4, the auxiliary lines L1, L2, L3 show the correlations in the shapes of the outer side surface 18, the concave surface 171, and the convex surface 172 of the bottle 1. The bottle 2 also has the same shape, and is not repeated herein. As shown in FIG. 3, one of the connecting parts and the auxiliary connecting parts is provided on the concave surfaces 171, 271, respectively, and the other on the concave surfaces 172, 272. Thus, the concave surface 171 of the bottle 1 connects to the convex surface 272 of the other bottle 2. The connecting parts and the auxiliary connecting parts of the bottles 1, 2 engage to connect.

Figure 5:
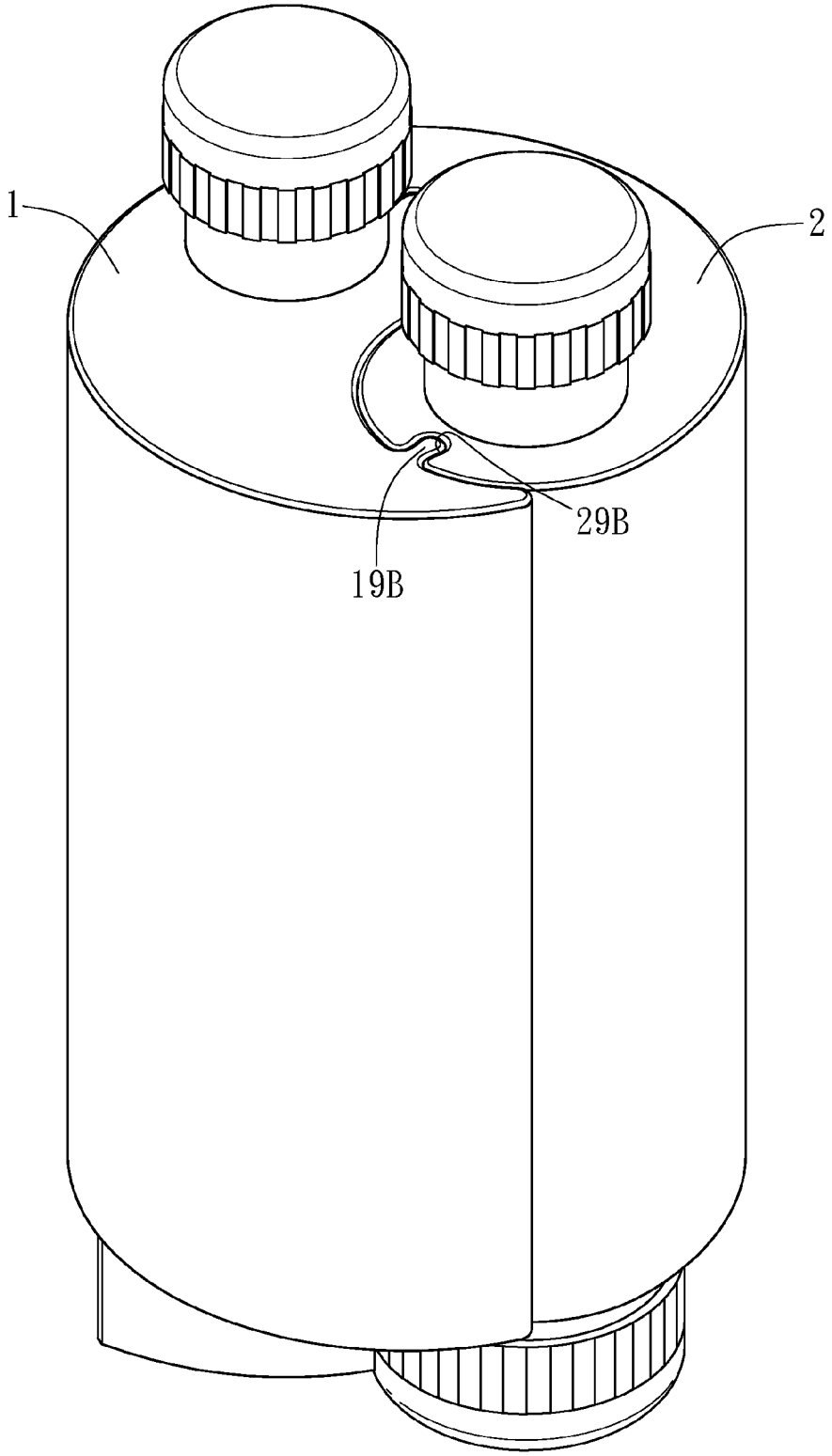
FIG. 5 is a three-dimensional assembly view of the second embodiment.
Figure 6:
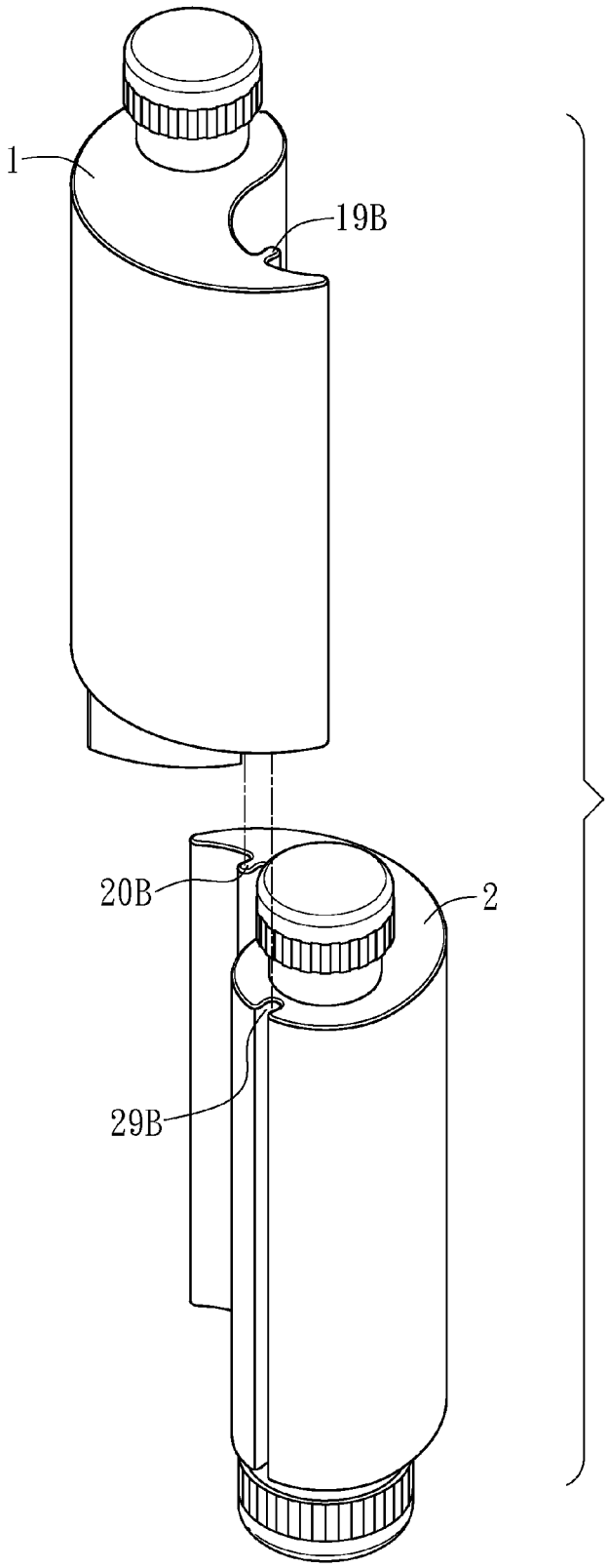
FIG. 6 is a three-dimensional exploded view of the second embodiment.
Figure 7:
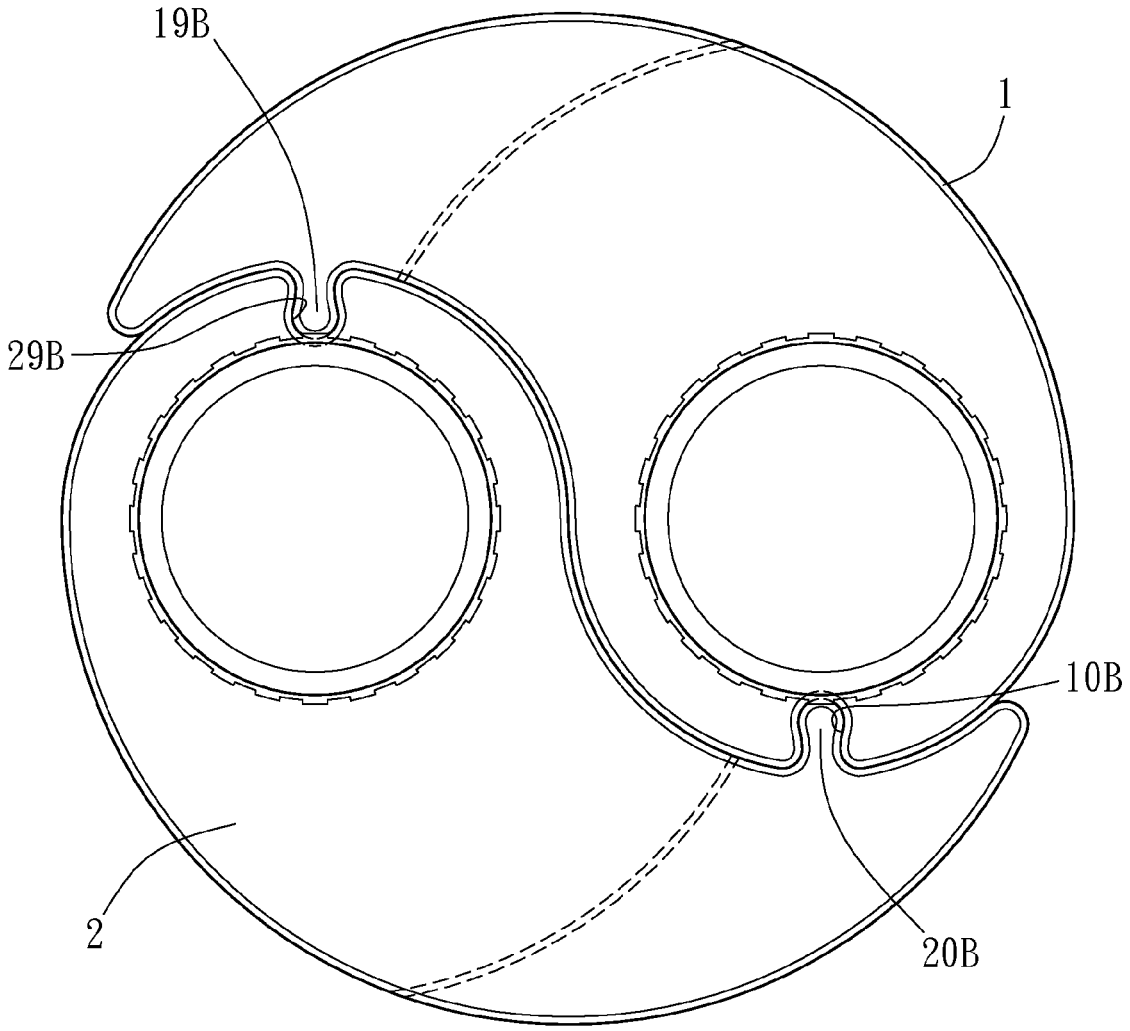
FIG. 7 is a top view of the second embodiment.
Figure 8:
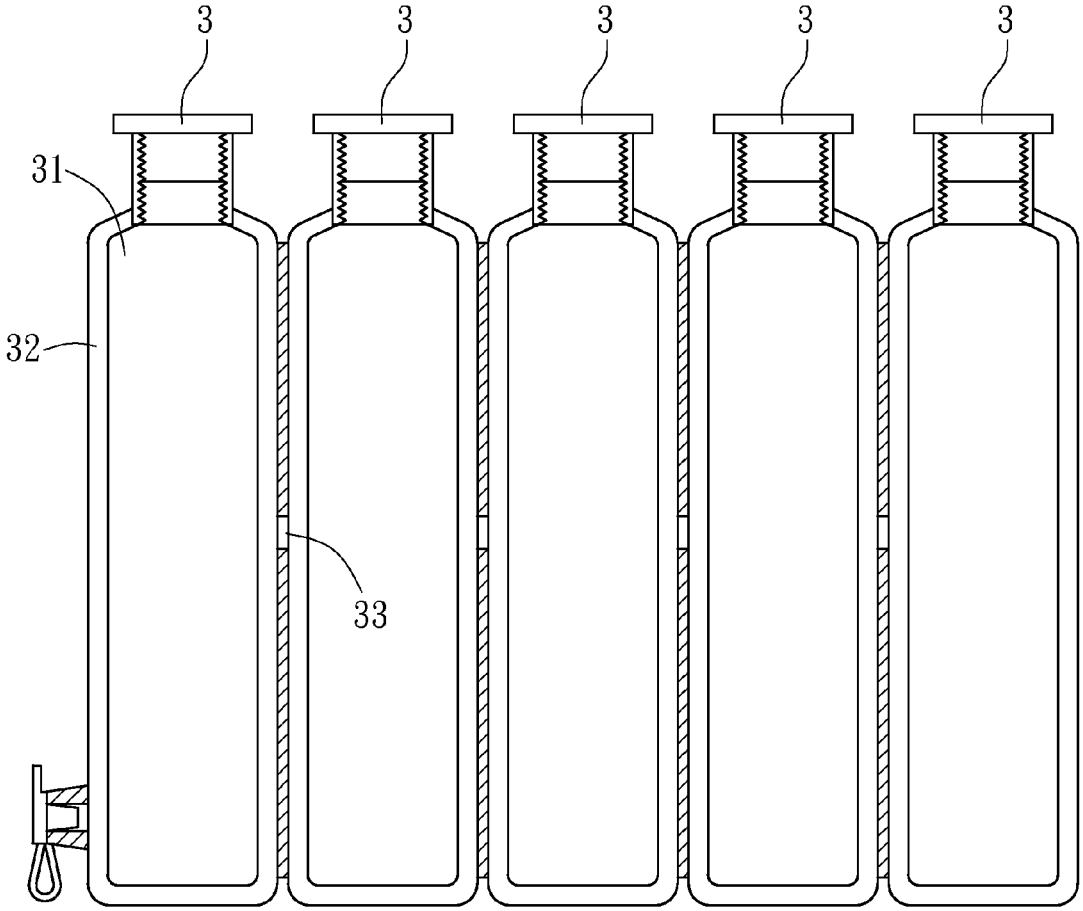
FIG. 8 PRIOR ART
FIG. 8 is a cross-sectional view of a conventional structure.

Please refer to FIGS. 5 to 7 for a second embodiment of the invention. It differs from the previous embodiment in that one of the connecting parts of the bottles 1, 2 is a first groove 29B extending from the top to the bottom of the bottle 2, while the other is a protruding bar 19B on the other bottle 1 corresponding to the first groove 29B. Likewise, one of the auxiliary connecting parts of the bottles 1, 2 is a second groove 10B extending from the top to the bottom of the first bottle 1, while the other is a second protruding bar 20B. By increasing the engaging area between the connecting parts and the auxiliary connecting parts and thus the friction in between, the two bottles 1, 2 are more firmly connected.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A container with multiple chambers and multiple openings, the container comprising two bottles, with the interior of each of the bottles formed with a chamber for accommodating a beverage, the chambers disconnected, and each of the chambers formed with an upper opening facing upward and a lower opening facing downward, the upper opening provided with an upper cover to seal the upper opening and the lower opening provided with a lower cover to seal the lower opening, and the surrounding surface of the each of the two bottles divided into a junction surface and an outer side surface;

wherein the two bottles are connected horizontally via the junction surface thereof, each of the junction surfaces has a connecting part to connect to or separate from each other; the outer side surface of each of the two bottles forms a semicircular arc shape while the junction surfaces of each of the two bottles are a concave surface and a convex surface connected smoothly; the concave surface and the convex surfaces also have semicircular arc shapes with the curvature radius thereof being half that of the outer side surfaces, so that a single cylindrical container is obtained when the two bottles are connected with the concave and convex surface of one bottle matching with the concave and convex surface of the other bottle.

2. The container with multiple chambers and multiple openings as in claim 1, wherein the connecting part of one bottle has a first concave structure and the connecting part of the other bottle has a first protruding structure to engage with the first concave structure.

3. The container with multiple chambers and multiple openings as in claim 2, wherein the junction surface of each of the two bottles is further provided with an auxiliary connecting part, with one having a second concave structure and the other having a second protruding structure to engage with the second concave structure, and the engaging direction of the two auxiliary connecting parts is parallel to the engaging direction of the connecting parts.

4. The container with multiple chambers and multiple openings as in claim 1, wherein at least one of the upper opening and the lower opening of each of the two bottles is provided with a filter extending toward the chamber thereof.

5. The container with multiple chambers and multiple openings as in claim 4, wherein the filters are provided at the lower openings of the two bottles, respectively, and are urged by the two lower covers against the rims of the lower openings.

* * * * *